United States Patent [19]

Nofer

[11] Patent Number: 4,848,613

[45] Date of Patent: Jul. 18, 1989

[54] TAMPER-EVIDENT CLOSURE CAP AND CONTAINER

[75] Inventor: Karl H. Nofer, Kitchener, Canada

[73] Assignee: Pano Cap (Canada) Limited, Ontario, Canada

[21] Appl. No.: 151,932

[22] Filed: Feb. 3, 1988

[30] Foreign Application Priority Data

Mar. 23, 1987 [CA] Canada ..... 532759

[51] Int. Cl.[4] ..... B65D 41/34

[52] U.S. Cl. ..... 215/252

[58] Field of Search ..... 215/252, 250

[56] References Cited

U.S. PATENT DOCUMENTS 4,609,115 9/1986 Moore et al. ..... 215/252

FOREIGN PATENT DOCUMENTS 2334750 1/1975 Fed. Rep. of Germany ..... 215/252

*Primary Examiner*—Donald F. Norton

*Attorney, Agent, or Firm*—Daryl W. Schnurr

[57] ABSTRACT

A tamper-evident closure cap and corresponding container have projections on a skirt of the cap corresponding to projections on a neck of the container. The skirt is conencted to a remainder of the cap by a series of severable tabs. The projections are shaped to override one another when the cap is turned onto said container but to interlock with one another when the cap is turned off said container. When the projections interlock, the force exerted on the cap severs the tabs, thereby severing the skirt from the cap and providing evidence of tampering. The cap and container are operable over a wide rnage of tolerances and the tabs can be very small when compared to previous caps and containers.

17 Claims, 3 Drawing Sheets

TAMPER-EVIDENT CLOSURE CAP AND CONTAINER

BACKGROUND OF THE INVENTION

1. Field of the Invention

This invention relates to a tamper-evident closure cap and corresponding container and, in particular, to a cap having a removable skirt with projections that correspond to projections on said container. When the cap is turned onto said container, the projections override one another and when the cap is turned off said container, the projections interlock with one another.

2. Description of the Prior Art

It is known to have a closure cap with a removable skirt connected to a remainder of said cap by severable tabs. However, with one type of known tamper-evident closure cap, a neck of a conainer has a circumferential ridge thereon and an interior surface of the skirt has a similar circumferential ridge. As the cap is turned onto the container, the ridge of the cap is designed to override the ridge of the container. As the cap is turned off said container, as long as the relative size of the cap and container are within acceptable tolerances, the ridge of the cap cannot override the ridge of the container and the tabs are severed, thereby removing the skirt from a remainder of said cap. In another known type of tamper-evident closure cap, the skirt has a circumferential flange that is hinged to a bottom edge of said skirt. A corresponding container has a circumferential ridge surrounding a neck thereof. As the cap is turned onto the container, the flange is compressed against an interior surface of the skirt so that it will override the ridge on the container. As the cap is turned off the container, as long as the relative size of the cap and container are within acceptable tolerances, the flange pivots about the hinged portion so that the flange cannot override the ridge on the container and the skirt is severed from a remainder of said cap. These known prior art tamper-evident closure caps suffer from a serious disadvantage in that the caps and containers must be manufactured within a very narrow tolerance in order for the tamper-evident parts of the cap to work properly on a container. It can be appreciated that the cap must be large enough so that the skirt will slide over the ridge on the container when the cap is turned onto the container but will not slide over said ridge when the cap is turned off the container. Often, the caps and containers are manufactured by different manufacturers. The close tolerances required cannot always be achieved and the caps do not always work properly. If the circumferential ridge on the skirt or on the cap is oversized or undersized, the tamper-evident features of the cap will either not work at all or the skirt will become severed from a remainder of the cap while the cap is being turned onto said container. Also, as the skirt of the cap must override the circumferential ridge on the container when the cap is being turned onto said container, tabs interconnecting the skirt with a remainder of the cap must be designed to be quite strong so that they will not sever prematurely. Since the tabs are strong, it can be difficult to turn the cap off the container as it is difficult to sever the tabs. The problem with tolerances is particularly important where caps and containers of relatively large diameters are utilized or where both the cap and container are constructed of plastic. With large diameter caps, a small percentage variance in the size of the cap or container can result in a very large size discrepancy so that the ridge on the cap simply overrides the ridge in the container when the cap is removed from the container. Similary, if the container and cap are both made of flexible and resilient materials, the ridges of the cap and container could also override one another. When this occurs, no evidence of tampering will exist when the cap is removed from the container and subsequently installed.

SUMMARY OF THE INVENTION

It is an object of the present invention to provide a tamper-evident closure cap that will operate satisfactorily through wide tolerances in the relative sizing of the cap and container. It is a further object of the present invention to provide a tamper-evident closure cap and container where tabs connecting a skirt to a remainder of the cap are subjected to minimal stress when the cap is turned onto said container.

In accordance with the present invention, a tamper-evident closure cap is provided for use with a container having a top with a neck having an opening therein. The neck of the container has at least one screw thread on an exterior surface thereof and a plurality of spaced projections surrounding the neck and being located beneath the screw thread when the container is in an upright position. All of the projections on the neck are located in a plane parallel to said top, said projections having tips on an outer edge thereof. The cap has a central portion with a periphery and a flange extending from said periphery. The flange has at least one screw thread on an inner surface and any screw threads on the cap correspond to any screw threads on the container. The flange has a cylindrical skirt extending from said flange beneath said screw thread of said cap when said cap is in an upright position. The skirt has an inside diameter that is slightly greater than an inside diameter of said flange. The skirt is held to said flange by a series of severable tabs, the skirt having a plurality of projections on an inner surface thereof. The projections on said cap have tips located on an inner edge thereof, the distance between two tips that are 180 degrees apart from one another being substantially equal to an inside diameter of said flange. The projections on the cap are located to interact with the projections on the container when the cap has been turned fully onto said container. The projections are shaped so that they do not interlock with one another as the cap is turned onto said container but do interlock with one another as the cap is turned off said container. The tabs are strong enough so that they do not sever when the cap is turned onto the container but do sever when a reasonable amount of force is applied in turning the cap off the container, the skirt thereby separating from said flange.

A tamper-evident closure cap and corresponding container includes a container having a top with a neck having an opening therein. The neck has at least one screw thread on an exterior surface thereof and a plurality of spaced projections surrounding said neck and being located beneath said screw thread when the container is in an upright position. All of the projections are located in a plane parallel to said top. The cap has a central portion with a periphery and a flange extending from said periphery. The flange has at least one screw thread on an inner surface thereof. Any screw threads on the cap correspond to any screw threads on the container. The flange has a cylindrical skirt extending from said flange beneath said screw thread of said cap when said cap is in an upright position. The skirt has an inside diameter that is slightly greater than an inside diameter of said flange. The skirt is held to said flange by a series of severable tabs. The skirt has a plurality of projections on an inner surface thereof. The projections on said cap have tips located at an inner edge thereof, the distance between two tips that are 180° apart from one another being substantially equal to an inside diameter of said flange. The projections on said cap are located to interact with the projections on said container when the cap has been turned fully onto said container. The projections on the cap and container being shaped so that they do not interlock with one another as the cap is turned onto said container but do interlock with one another as the cap is turned off said container. The tabs are strong enough so that they do not sever when the cap is turned onto said container but do sever when a reasonable amount of force is applied in turning the cap off the container, the skirt thereby separating from the flange.

DESCRIPTION OF A PREFERRED EMBODIMENT

Figure 1:
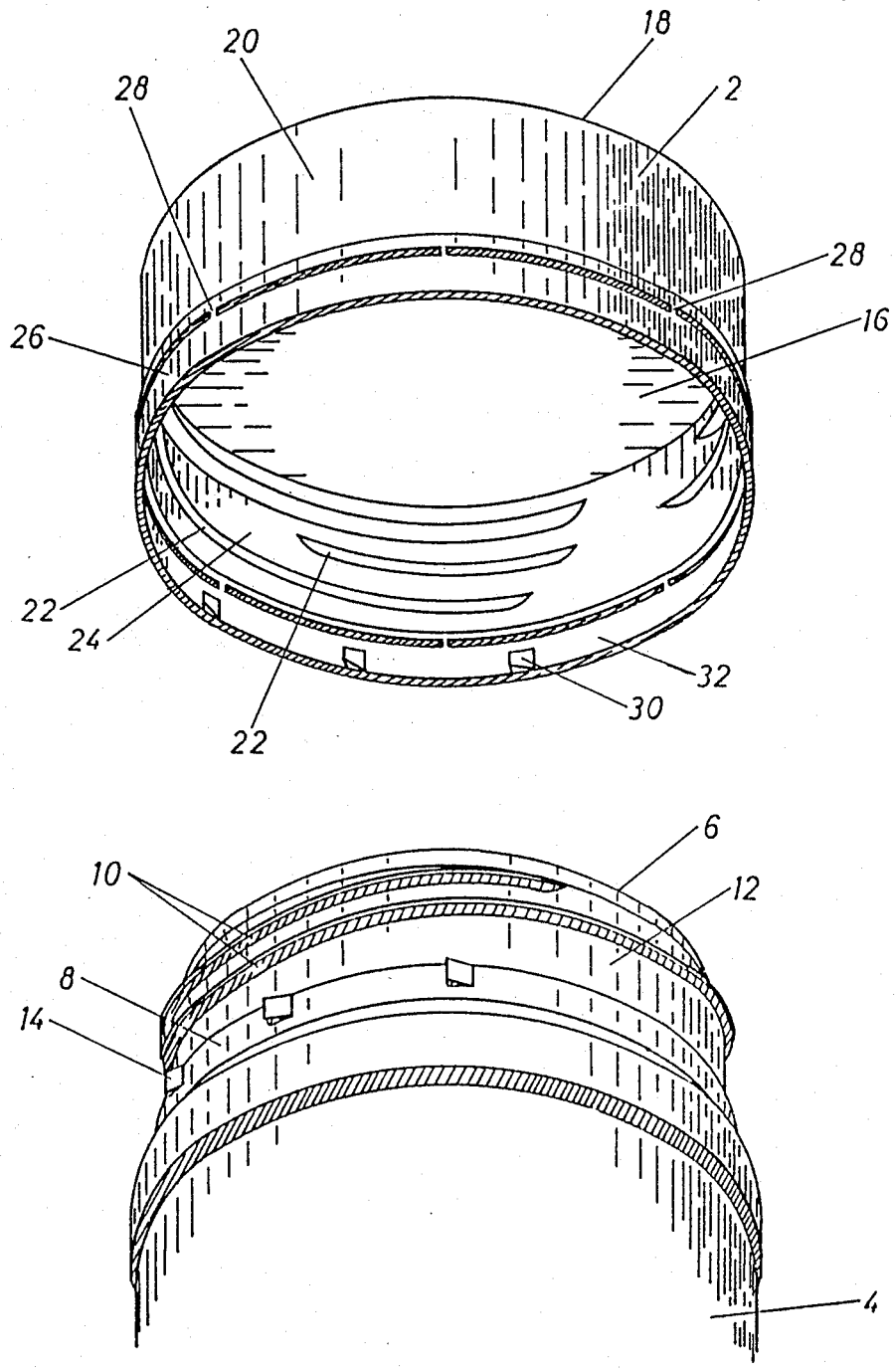
FIG. 1 is an exploded partial perspective view of a cap and container.

Referring to the drawings in greater detail, in FIG 1, a closure cap 2 is designed to be turned onto a container 4. The container 4 has a top 6 with a neck 8 and an opening (not shown in FIG. 1), said opening being surrounded by the top 6. The neck 8 has screw threads 10 mounted on an exterior surface 12. A plurality of spaced projections 14 surround said neck 8 and are located beneath the screw threads 10 when the container 4 is in an upright position. All of the projections 14 on the neck 8 are located in a plane parallel to the top 6. The cap 2 has a central portion 16 with a periphery 18 and a flange 20 extending from said periphery. The flange 20 has screw threads 22 on an inner surface 24 thereof. The screw threads 22 of the cap 2 correspond to the screw threads of the container 4. The flange 20 has a cylindrical skirt 26 extending therefrom beneath said screw thread 22 when the cap 2 is in an upright position. The skirt 26 is held to the flange 20 by a series of severable tabs 28. The skirt 26 has a plurality of projections 30 on an inner surface 32 thereof. The projections 30 on the cap 2 are located to interact with the projections 14 on the container 4 when the cap 2 has been turned fully onto said container 4. The projections are shaped so that they do not interlock with one another as the cap is turned onto said container but do interlock with one another as the cap is turned off said container. The tabs 28 are strong enough so that they do not sever when the cap 2 is turned onto the container 4 but do sever when a reasonable amount of force is applied in turning the cap off the container, the skirt 26 thereby separating from said flange 20.

Figure 2:
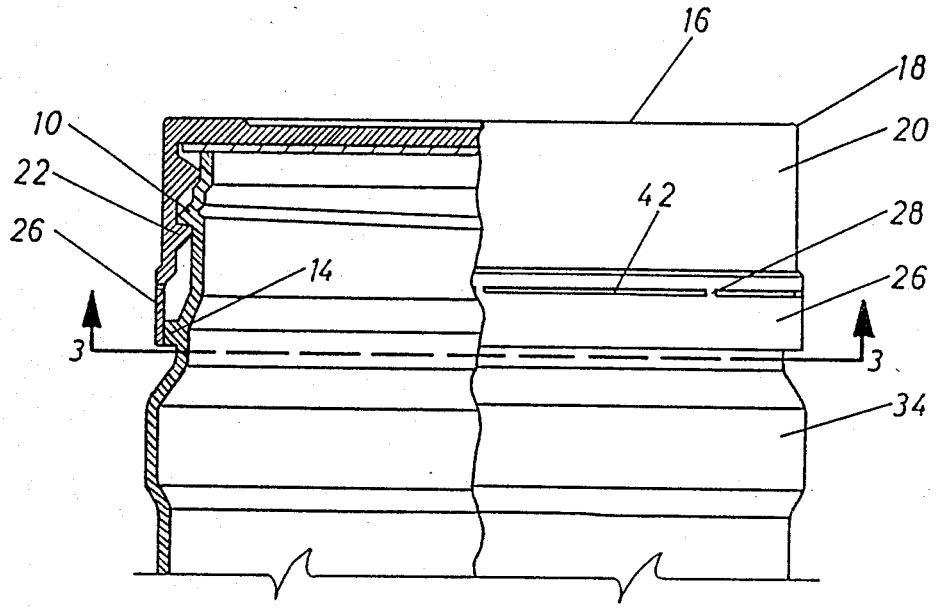
FIG. 2 is a partial sectional view of a closure cap and coresponding container in a closed position.

In FIG. 2, it can be seen that the skirt 26 has an inside diameter that is slightly greater than an inside diameter of a remainder of the cap 2 represented by the flange 20. As can be seen from both FIGS. 1 and 2, the container 4 has a circumferential collar 34 located beneath the projections 14 when the container is in an upright position. The purpose of the collar 34 is to provide a resting place for the skirt 26 after it has become severed from the flange 20.

Figure 3:
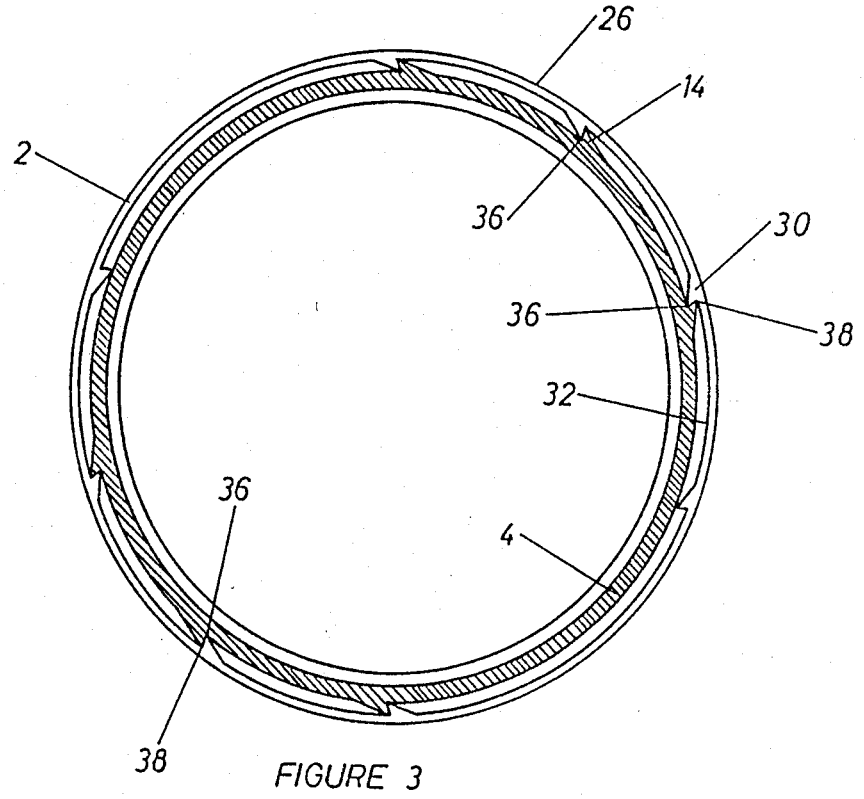
FIG. 3 is a sectional view along the lines 3—3 of FIG. 2 with projections of the cap interlocked with projections of the container.

In FIG. 3, it can be seen that the projections 30 on the cap 2 have tips 36 located at an inner edge thereof. The distance between two tips 36 that are 180 degrees apart from one another is substantially equal to the inside diameter of the remainder of the cap. This sizing arrangement of the projections allows the projections 30 to easily slide over the screw threads of the container 4. The projections 14 of the container 2 have tips 38 on an outer edge thereof. The tips 38 are sized relative to the inside diameter of the skirt 26 so that they touch an inner surface 32 of said skirt when the cap 2 is turned onto said container 4. The cap and container shown in FIG. 3 are in a closed position with the projections 30 of the cap 2 interlocked with the projections 14 of the container 4. The projections 30 on the cap 2 are all identical to one another. Further, the projections 14, 30 on the container 4 and cap 2 respectively are identical to one another. It can be seen that there are eight projections 30 on the cap 2, said projections being spaced equally from one another except that two projections that would be 180 degrees apart from one another are omitted. The omission of these two projections allows the cap to be easily removed from a mold without damaging the projections 30. It can further be seen that the container 4 has a total of six projections 14 thereon, three on each side of the container. While it is possible to increase or decrease the number of projections on either or both of the cap and container, the arrangement of projections shown in FIG. 3 provides a good result and allows both the cap and the container to be removed from molds, without damaging the projections.

Figure 4:
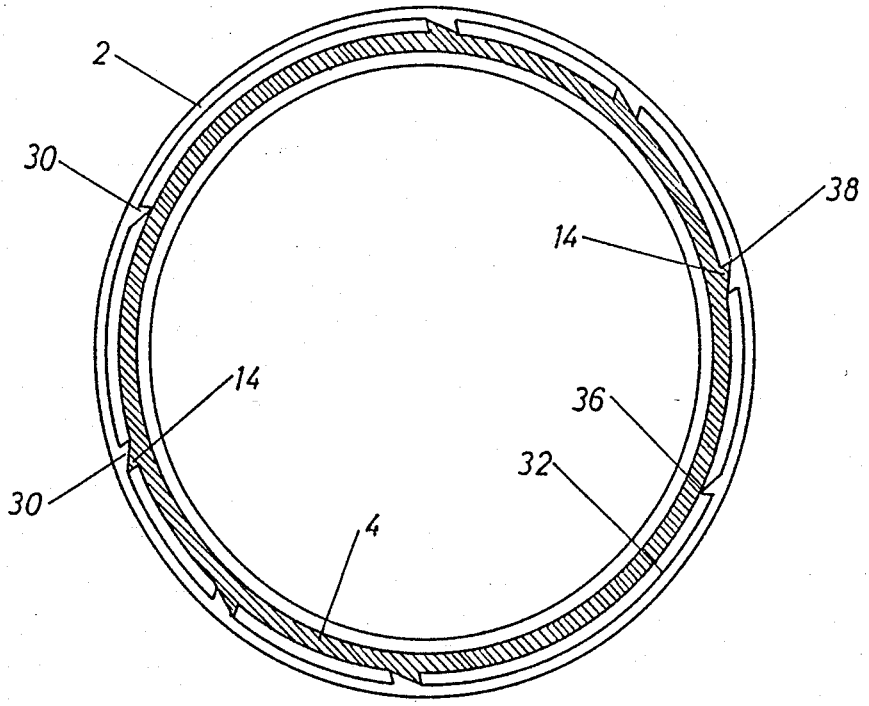
FIG. 4 is a sectional view of the cap and container with the projections overriding one another.

FIG. 4 is virtually identical to FIG. 3 except that the cap is in the process of being installed on the container and the projections 30 of the cap are overriding the projections 14 of the container.

Figure 5:
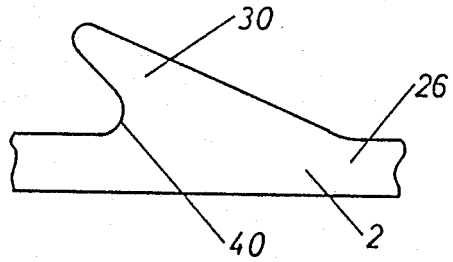
FIG. 5 is an enlarged partial view of one projection with one angle of the projection being substantially 135 degrees.
Figure 6:
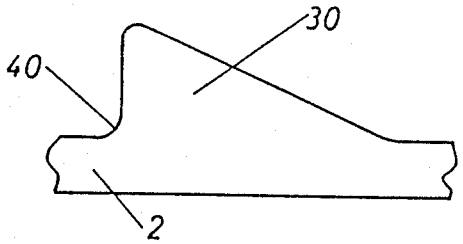
FIG. 6 is an enlarged partial view of one projection with one angle of the projection being substantially 90 degrees.
Figure 7:
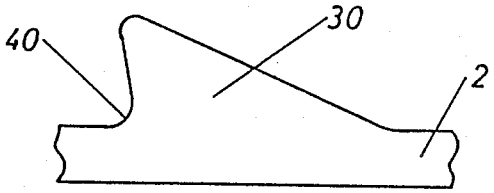
FIG. 7 is an enlarged partial view of one projection with one angle of the projection being substantially 100 degrees.

In FIGS. 5, 6 and 7, it can be seen that the projections have a triangular cross-section when viewed from a direction along a centre axis of said cap. The projections shown in these figures could either be projections on the cap or projections on the container but are described with reference numerals as though they were projections on the cap. In FIG. 5, the projection 30 has one angle 40 located immediately adjacent to the skirt 26 that is substantially 135 degrees. In FIG. 6, the angle 40 is substantially 90 degrees. In FIG. 7, the angle 40 is substantially 100 degrees. The angle shown in FIG. 7 is the preferred angle but the angle could range anywhere from substantially 90 degrees to substantially 135 degrees. The angle 40 could even be slightly less than 90 degrees but there would not be any point in designing the angle in that way as the projections would then have a slight tendency to override one another when the cap is turned off the container. Similarly, the angle 40 could be greater than 135 degrees. However, as the angle 40 increases beyond 135 degrees, the projection 30 will become weaker and the tip 38 will tend to flex to a greater degree. Also, the projections 14, 30 will become longer and will be in contact with one another over a much greater distance as the cap is turned onto the container. It is therefore preferred that the angle 40 be no greater than substantially 135 degrees.

In operation, when the cap is turned onto the container, the projections 30 readily clear the screw threads 10 of the container and override the projections 14 as shown in FIG. 4. When the cap has been placed in a closed position relative to the container as shown in FIG. 2, and it is subsequently desired to remove the cap from the container, the cap must be turned in an opposite direction relative to the container. Even if the projections 14, 30 are not interlocked with one another when the cap is in a closed position, as soon as the cap is rotated a short distance relative to the container, the projections 30 will become interlocked with the projections 14. As a reasonable amount of force is applied to the cap in an appropriate direction to remove the cap from the container, the tabs 26 will sever and the skirt will separate from the flange and remaining part of the cap. The skirt will then rest on the collar 34, the severed skirt providing evidence that the cap and container have been previously opened.

While a mold could be designed to create the tabs 28, it is preferred that the mold be designed so that the tabs 28 and corresponding slit 42 be non-existent when the cap is removed from the mold. The slit 42 is then preferably cut into the skirt 26 by a circular knife after the cap is removed from the mold, thereby leaving the tabs 28. The size of the tabs 28 relative to the slit 42 can be easily controlled by the depth that the circular knife is inserted through the skirt 26. Since little pressure is exerted on the tabs when the cap is turned onto the container, the tabs can be very small relative to the circumference of the cap. For example, it has been found that tabs with a depth substantially equal to or slightly less than the depth of the threads work satisfactorily. The tabs do not sever when the cap is turned onto a container, but do sever quite easily when the cap is turned off said container.

Numerous variations to the cap and container, within the scope of the attached claims, will be readily apparent to those skilled in the art. For example, the number, shape and distance between adjacent projections could be readily altered. Similarly, the size of the tabs can be relatively changed depending on the appropriate force required to remove the cap from the container and to sever the tabs.

What I claim as my invention is:

1. A tamper-evident closure cap for use with a container having a top with a neck having an opening therein, said neck having at least one screw thread on an exterior surface thereof and a plurality of spaced projections surrounding said neck and being located beneath said screw thread when the container is in an upright position, all of said projections being located in a plane parallel to said top, said projections having tips on an outer edge thereof, said cap comprising a central portion having a periphery with a flange extending from said periphery, said flange having at least one screw thread on an inner surface, any screw threads on the cap corresponding to any screw threads on said container, said flange having a cylindrical skirt extending from said flange beneath said screw thread of said cap when said cap is in an upright position, said skirt having an inside diameter that is slightly greater than an inside diameter of said flange, said skirt being held to said flange by a series of severable tabs, said skirt having a plurality of projections on an inner surface thereof, said projections on said cap having tips located at an inner edge thereof, the distance between two tips that are 180 degrees apart from one another being substantially equal to an inside diameter of said flange, said projections on said cap being located to interact with the projections on said container when the cap has been turned fully onto said container, said projections being shaped so that they do not interlock with one another as the cap is turned onto said container but do interlock with one another as the cap is turned off said container, the tabs being strong enough so that they do not sever when the cap is turned onto the container but do sever when a reasonable amount of force is applied in turning the cap off the container, the skirt thereby separating from said flange.

2. A closure cap as claimed in claim 1 wherein the skirt is sized so that an inner surface of said skirt touches the tips of the projections on said container when the cap is turned onto said container.

3. A closure cap as claimed in claim 1 wherein the projections have a triangular cross-section when viewed from a direction along a centre axis of said cap.

4. A closure cap as claimed in claim 3 wherein the triangular cross-section has one angle, located immediately adjacent to said skirt, of at least substantially 90 degrees and the other two angles are substantially less than 90 degrees.

5. A closure cap as claimed in claim 4 wherein one angle immediately adjacent to said skirt ranges from substantially 90 degrees to substantially 135 degrees, each triangular shaped projection having a first angle and a second angle that are located on an inner surface of said skirt with a third angle being located radially inward from said skirt, said first angle being located forward of said second angle when said cap is being turned onto said container.

6. A closure cap as claimed in claim 1 wherein all of the projections on the cap are identical to one another.

7. A closure cap as claimed in claim 1 wherein all of the projections on the cap are identical to those on the container.

8. A closure cap as claimed in claim 1 wherein there are eight projections on said cap, said projections being spaced equally from one another except that two projections, that would be 180 degrees apart from one another are omitted.

9. A tamper-evident closure cap and corresponding container in combination, said cap and container comprising a container having a top with a neck having an opening therein, said neck having at least one screw thread on an exterior surface thereof and a plurality of spaced projections surrounding said neck and being located beneath said screw thread when the container is in an upright position, all of said projections being located in a plane parallel to said top, said cap having a central portion with a periphery and a flange extending from said periphery, said flange having at least one screw thread on an inner surface thereof, any screw threads on the cap corresponding to any screw threads on said container, said flange having a cylindrical skirt extending from said flange beneath said screw thread of said cap when said cap is in an upright position, said skirt having an inside diameter that is slightly greater than an inside diameter of said flange, said skirt being held to said flange by a series of severable tabs, said skirt having a plurality of projections on an inner surface thereof, said projections on said cap having tips located at an inner edge thereof, the distance between two tips that are 180 degrees apart from one another being substantially equal to an inside diameter of said flange, said projections on said cap being located to interact with the projections on said container when the cap has been turned fully on to said container, said projections being shaped so that they do not interlock with one another as the cap is turned onto said container but do interlock with one another as the cap is turned off said container, the tabs being strong enough so that they do not sever when the cap is turned onto the container but do sever when a reasonable amount of force is applied in turning the cap off the container, the skirt thereby separating from said flange.

10. A cap and container are claimed in claim 9 wherein the projections on the container have tips on an outer edge thereof, said tips on said container being sized relative to the inside diameter of said skirt so that they touch an inner surface of said skirt when the cap is turned onto said container.

11. A cap and container as claimed in claim 9 wherein the projections have a triangular cross-section when viewed from a direction along a centre axis of said cap.

12. A cap and container as claimed in claim 11 when the triangular cross-section has one angle, located immediately adjacent to said skirt, of at least substantially 90 degrees and the other two angles are substantially less than 90 degrees.

13. A cap and container as claimed in claim 12 wherein one angle immediately adjacent to said skirt ranges from substantially 90 degrees to substantially 135 degrees, each triangular-shaped projection having a first angle and a second angle that are located on an inner surface of said skirt with a third angle being located radially inward from said skirt, said first angle being located forward of said second angle when said cap is being turned onto said container.

14. A cap and container as claimed in claim 9 wherein all of the projections on the cap are identical to one another.

15. A cap and container as claimed in claim 9 wherein all of the projections on the cap and on the container are identical to one another.

16. A cap and container as claimed in claim 9 wherein there are eight projections on said cap, said projections being spaced equally from one another except that two projections, that would be 180 degrees apart from one another are omitted.

17. A cap and container as claimed in claim 9 wherein there are six projections on said container, three on one side of said neck and three on an opposite side of said neck.

* * * * *